United States Patent [19]

Nagoya et al.

[11] 4,282,032

[45] Aug. 4, 1981

[54] DIRECT METHOD FOR PRODUCTION OF HIGH-GRADE, HIGH-PURITY FERROMANGANESE

[75] Inventors: Yoshishige Nagoya, Tokyo; Kosuke Murai, Hachinoheshi; Hirota Amano, Hachinoheshi; Yoshisada Soga, Hachinoheshi, all of Japan

[73] Assignee: Pacific Metals Co., Ltd., Tokyo, Japan

[21] Appl. No.: 89,749

[22] Filed: Oct. 30, 1979

[51] Int. Cl.[3] ..... C22B 47/00

[52] U.S. Cl. ..... 75/80; 75/134 M

[58] Field of Search ..... 75/80, 134 M; 266/233

[56] References Cited

U.S. PATENT DOCUMENTS

| | | | |
|---|---|---|---|
| 2,147,070 | 2/1939 | Weinheimer et al. | 266/233 |
| 2,931,708 | 4/1960 | Aamot | 75/80 |

*Primary Examiner*—M. J. Andrews

*Attorney, Agent, or Firm*—Wenderoth, Lind & Ponack

[57] ABSTRACT

A direct method for the production of high-grade, high-purity ferromanganese comprising the steps of charging a molten Mn-containing material, a non-carbonaceous reducing agent and a slagging material in a reaction vessel and subjecting the reaction vessel to horizontal eccentric circular motion to mix and agitate the contents of the vessel, whereby the Mn oxide contained in the molten Mn-containing material is reduced by the non-carbonaceous reducing agent.

2 Claims, No Drawings

DIRECT METHOD FOR PRODUCTION OF HIGH-GRADE, HIGH-PURITY FERROMANGANESE

BACKGROUND OF THE INVENTION

1. Field of the Invention

This invention relates to a direct method for the production of high-grade, high-purity ferromanganese, more particularly, to a direct method for production of ferromanganese having high Mn content and exceedingly low C and P content.

2. Description of the Prior Art

Demand has increased in recent years for high quality steel materials having superior qualities in terms of workability, durability, weatherability, resistance to particular atmospheres, etc. At the same time, there has arisen a need to produce such steel materials more economically. In line with these trends, higher quality has come to be demanded for Mn-containing ferroalloys for use as deoxidization agents and alloying additives in the production of steel. In certain applications, for example, there has arisen a need for ferromanganese having a composition wherein Mn≧90%, Si≦1.5%, C≦0.1%, and P≦0.05%.

Up to now, the need for such a high quality Mn source with low impurity content has been met by electrolytically produced metallic Mn or by medium- or low-carbon ferromanganeses. Electrolytic Mn, although satisfactory from the point of impurity content, is disadvantageous because of its high cost of production and because it exists in the form of thin flakes which, being light in weight, give a low yield in use. On the other hand, medium- and low-carbon ferromanganeses, although lower in price than electrolytic Mn, are disadvantageous in a number of points. They require the use of complex production methods, give low Mn yield in the course of production and result in a high unit electrical power cost. Moreover, as will be noted from the standards for Grade A low-carbon ferromanganeses (85–90% Mn, 0.1–0.7% C, not more than 2.0% Si, not more than 0.20% P and not more than 0.02% S), it is not easy to obtain carbon-containing manganese products which meet the quality requirements set forth above, especially in terms of C and P content.

SUMMARY OF THE INVENTION

The object of the present invention is to provide a direct method for producing high-grade, high-purity ferromanganese which overcomes the defects inherent in the conventional methods and which is capable of producing, at low cost and in large quantities, ferromanganese of such high grade and purity that it can be used in applications where up to now it has been necessary to use high-cost metallic Mn produced by electrolysis.

The present invention accomplishes the abovementioned object by providing a direct method for producing high-grade, high-purity ferromanganese which comprises the steps of charging in a reaction vessel a molten Mn-containing material, a non-carbonaceous reducing agent and a slagging material and subjecting the reaction vessel to horizontal eccentric circular motion to mix and agitate the contents of the vessel, whereby the Mn oxide contained in the Mn containing material is reduced by the non-carbonaceous reducing agent.

DETAILED DESCRIPTION OF THE INVENTION

In the method according to the present invention, the first step consists of charging a molten Mn-containing material, a non-carbonaceous reducing agent and a slagging material in a reaction vessel. The Mn-containing material used at this time can be any such material having an Mn content falling within the preferred range of 10 to 40%. As the non-carbonaceous reducing agent there may be used an Si-containing alloy, an Al-containing alloy, a Ca-containing alloy or a combination of these.

Once a molten Mn-containing material, a non-carbonaceous reducing agent and a slagging material have been charged in a reaction vessel in accordance with the present invention, it is possible, merely by subjecting the vessel to horizontal eccentric circular motion to mix and agitate the contents thereof, to easily produce a large quantity of high-grade, high-purity ferromanganese comprising, for example, not less than 90% Mn, not more than 1.5% Si, not more than 0.1% C and not more than 0.05% P.

Although for producing ferromanganese having such high grade and purity as this it is necessary to use a molten Mn-containing material which is low in Fe and P content, Mn-containing materials comprising 10 to 40% Mn and having low Fe and P content are relatively easy to obtain. For example, there can be used the readily available product obtained as a product in the process of producing Mn-containing ferroalloys. Moreover, as any Fe and P contained in the above-mentioned non-carbonaceous reducing agent will be almost totally transferred to the high quality ferromanganese produced according to the method of this invention, care should be taken to select a non-carbonaceous reducing agent of high quality.

Conventional methods for producing Mn products by using a carbonaceous or non-carbonaceous reducing agent to reduce Mn-containing oxides have been known as dry methods for producing metallic Mn, and such methods continue to be used in some countries even today. A detailed description of such a method can be found, for example, on pages 136 to 157 of "Production of Ferroalloys, 2nd Ed." written by V. P. Elyutin et al. and published by the National Science Foundation, Washington, in 1961. Here there is found a detailed description of a method for producing metallic Mn containing 88 to 95% Mn, 0.8 to 4.0% Si, 0.05 to 0.50% P, 1.0 to 1.5% Al, 2.0 to 3.0% Fe, 2.5 to 4.0% Cu and 0.10 to 0.20% C (differing depending on the standard to be met). The process described is, however, very complex and involves production of high-Mn, low-P slag→production of intermediate high carbon ferromanganese→production of high-grade silicon-manganese→reduction of slag using high-grade silicon-manganese→production of metallic Mn. Not only is this method complex, but it also entails other problems such as a low Mn yield. In "Electric Smelting Process" written by A. G. E. Robiette and published by Charles Griffin & Company Limited in 1973 there is a passage on pages 143 and 144 under the heading of "Upgrading of manganese ore" which points out that if a low-Mn, High-P pig iron and high-Mn, low-Fe and low-P Mn-rich slag (comprising, for example, 52% MnO and 0.6% FeO) is produced from low grade manganese ore, it is possible by reducing this slag with metallic Si or Al to obtain metallic Mn containing not less than 97% Mn and that this method was in fact used in the past in Scandinavia but has since fallen out of use for economic reasons with the appearance of electrolytically produced metallic manganese.

As is clear from the examples given above, it has up to now been a required condition in the production of metallic Mn (the high-grade, high-purity ferromanganese produced in accordance with the present invention fully qualifies as "metallic manganese" from the point of Mn content) to produce a so-called "Mn-rich slag" having a high Mn content.

In contrast the method according to the present invention does not require that the Mn content of the molten Mn-containing material have a particularly high Mn content and there is no restriction whatsoever on what kind of molten Mn-containing material is used insofar as it has an Mn content falling in the range of from 10 to 40%.

The reason for setting the preferred range of Mn content of the molten Mn-containing material at between 10 and 40% is that when the Mn content is less than 10% the production cost according to this invention is disadvantageously high and when the Mn content exceeds 40% there is one disadvantage in that the cost of producing the molten Mn-containing material itself becomes high and another in that use of a molten Mn-containing material having an Mn content of over 40% has a highly corrosive effect on the refractory material used to line the reaction vessel.

Up to now, molten Mn-containing materials having low Mn content, i.e. having an Mn content of less than about 15%, have been discarded as requiring too much cost for the recovery of the Mn they contain. Thus, one object of the present invention is to provide a method for the recovery of the Mn content of such conventionally discarded molten Mn-containing materials in the form of high-grade, high-purity ferromanganese.

The method of producing a metal by reducing a metal oxide with a non-carbonaceous reducing agent is known as the thermit reaction method and in carrying out this method use is generally made of the heat generated at the time of the reaction between the metal oxide and the non-carbonaceous reducing agent. In other words, in the thermit method as it is ordinarily carried out, the mixture of the metal oxide and the non-carbonaceous reducing agent is heated to a certain temperature and, once the reaction has begun, the reduction reaction thereafter proceeds using only the heat of reaction. Consequently, in the thermit method, it is necessary for the metal oxide and the non-carbonaceous reducing agent to be thoroughly mixed so as to permit the two materials adequate opportunity to come into contact with each other.

Among the conventional methods used for carrying out the thermit reaction, one is known as the electric furnace method and involves first charging either molten metal oxide or molten non-carbonaceous reducing agent in an electric furnace and then carrying out the reaction by adding either non-carbonaceous reducing agent or metal oxide little by little to the molten material of the other type first placed in the furnace, and another is known as the re-ladle method and involves the use of two reaction vessels each containing a mixture of the metallic oxide and non-carbonaceous reducing agent (one being in molten state) with the contents of the vessels being poured back and forth to promote blending.

As the electric furnace method has no mixing effect, the thermit reaction occurs only at the surface of contact between the molten material (the lower layer in the electric furnace) and the added material (the upper layer in the electric furnace) so that the efficiency of the reaction is poor and as a consequence the yield is low and the quality of the product is degraded. What is more, in this method it is impossible to prevent carbon from the electrode of the electric furnace from entering the metal so that the product is invariably contaminated with carbon. In the re-ladle method, on the other hand, the drop in temperature that occurs at the time of transferring the contents of the two reaction vessels back and forth also has an adverse effect on the efficiency of reaction (which is on a level with that in the electric furnace method) and causes a decrease in yield.

A number of methods have been proposed for preventing a decline in reaction efficiency in the thermit reaction method. For example, U.S. Pat. No. 3,347,664 proposes to promote mixing of the metal phase and the slag phase in the vessel used for carrying out thermit reaction by blowing high pressure inert gas into the vessel from gas injection holes provided in the bottom thereof. This system has the demerit of requiring the blowing of gas and of necessitating extra expense in the fabrication of the reaction vessel. Moreover, although the examples given in connection with the patented method show an improvement in yield, the products obtained are high in impurities, particularly in their C and Si contents, in spite of the fact that the raw material used in the invention is a molten manganese-containing oxide material having the same range of Mn content (10–40%) as the molten Mn-containing material used in the present invention.

It was taught by Shindo et al. in U.S. Pat. No. 3,652,263 issued April 9, 1974 that when a reaction vessel was subjected to horizontal eccentric circular motion the contents thereof produced a special wave motion which greatly improved the mixing and agitating state and brought the components contained in the vessel into continuous and good contact, whereby the reaction among the components was quickly brought toward a state of equilibrium.

In the studies in connection with the present invention, the present inventors further discovered that this type of horizontal eccentric circular motion is also exceedingly effective when applied to a reaction vessel wherein a molten Mn-containing material is to be subjected to a reducing reaction using a non-carbonaceous reducing agent.

Considering, for example, a case where the present invention is carried out using a molten Mn-containing material having a very low Mn content of, say, 10%, it is obvious from stoichiometric calculations that in order to produce a high grade ferromanganese containing not less than 90% Mn using a non-carbonaceous reducing agent, it will be necessary to decrease the amount of added non-carbonaceous reducing agent in proportion as the Mn content of the molten Mn-containing material is low. In such a case there is a danger that it may be impossible to obtain adequate heat to maintain the reaction and in the aforementioned electric furnace method and re-ladle method the temperature is apt to drop to the point where the reaction fails to proceed any further.

In contrast when a reaction vessel capable of performing horizontal eccentric circular motion in accordance with the present invention is used, the reaction proceeds very rapidly and completely so that it is possible to adequately recover high-grade, high-purity ferromanganese even from a low-grade molten manganese-containing material.

In a case where the molten Mn-containing material is sufficiently high in temperature and, moreover, has an adequately high Mn content (meaning an Mn content of over about 20%), it is possible by using a reaction vessel capable of horizontal eccentric circular motion to easily produce a high-grade, high-purity ferromanganese fully meeting the aforesaid content requirements even when the non-carbonaceous reducing agent is used, as is, in the form of solid without heat treatment. It is also possible to produce high-grade, high-purity ferromanganese by the method of the present invention without entailing any particular problems when, as in the case described above, the Mn content of the molten Mn-containing material is low. However, in a case where the temperature of the low-Mn molten Mn-containing material is low or where it is necessary to add a large amount of slagging material in order to adjust the basicity, it is sometimes preferable to preheat the non-carbonaceous reducing agent or to use the said agent in molten form. When such measures are taken, there will be no difficulty in maintaining an adequately high temperature for the reaction.

Provided that there are no problems with the raw materials, namely the molten Mn-containing material, the non-carbonaceous reducing agent and the slagging material, it is possible by the method described above to, in a short period of time, produce a large quantity of high-grade, high-purity ferromanganese having, for example, a composition wherein Mn≧90%, Si≦1.5%, C≦0.1% and P≦0.05%. Thus, as loss of Mn due to volatization is very slight, it is possible to efficiently produce high-grade, high-purity ferromanganese even from a molten material having low Mn content such as that mentioned above.

In the method according to the present invention, since the amount of metal produced by the reduction with the non-carbonaceous reducing agent is small in the case where a molten Mn-containing material having a low Mn content is used as the raw material, it is, particularly in such cases, effective for the purpose of obtaining substantial amount of metal to conduct the operation with a high percentage of reducing agent in the non-carbonaceous reducing agent (for example, with an increased percentage of silicon in ferrosilicon) which is first added to the metal. In this case, recovery rate of Mn from the molten Mn-containing material becomes extremely high and, generally speaking, the Mn content of the slag following completion of reduction is 3% or less. In a preferred mode of operation, the slag with reduced Mn content is removed and the reducing operation is carried out again with fresh molten Mn-containing material and non-carbonaceous reducing agent added to the reaction vessel. When, after several repetitions of this operation, a substantial amount of metal has accumulated in the reaction vessel, molten Mn-containing material only or molten Mn-containing material and an amount of non-carbonaceous reducing agent not exceeding the amount stoichiometrically required for reducing the Mn from said molten Mn-containing material are added to the reaction vessel to obtain high-grade, high-purity ferromanganese having the desired composition. As a result of this procedure, the slag produced in the final reduction step may have a high concentration of Mn and, when it does, it can be used as the molten Mn-containing material in the succeeding operation. Moreover, as the Mn content of the slag produced in the course of the several repetitions of the reducing process, is, as mentioned above, as low as 3%, it can be sold as a fertilizer or as material for use in producing fertilizers.

In the horizontal eccentric circular motion to which the reaction vessel is subjected in the course of the reduction process, the reaction vessel is eccentrically shaken with the center of the vessel rotated in a small circle. This type of horizontal eccentric circular motion causes the mixture of molten Mn-containing material, non-carbonaceous reducing agent and slagging material to undergo a special wave motion during which the reaction proceeds. In carrying out the reduction reaction under this horizontal eccentric circular motion, there exists a close relationship among the inner diameter of the reaction vessel, the volume (depth) of the mixture in the vessel and the rate of circular motion. In order to achieve efficient and rapid reduction under the mixing and agitating action produced by the special wave motion, it is necessary to maintain these factors in a fixed relationship which can be experimentally determined. In the present invention, the rate of circular motion is carried out at between 35 and 60 cycles per minute, preferably at between 40 and 50 cycles per minute.

Thus, as has been set forth above, the method of the present invention is capable of easily and efficiently producing high-grade, high-purity ferromanganese from a molten Mn-containing material in a single step (or, as required, in several steps). Moreover, the method of this invention is advantageous in that it permits effective utilization of materials having an Mn content of only 10% which, up to now, have been discarded as worthless. As a consequence, the method for producing high-grade, high-purity ferromanganese according to the present invention is highly significant from both a technical and an economic point of view.

The present invention will now be described in detail with respect to working examples.

The compositions of the molten Mn-containing materials, non-carbonaceous reducing agent, slagging materials etc. used as raw materials in the examples set forth below are shown in Table 1.

TABLE 1

| No. | Raw material | Chemical composition (%) | | | | | | | | | |
|---|---|---|---|---|---|---|---|---|---|---|---|
| | | T.Mn | T.Fe | $SiO_2$ | CaO | MgO | $Al_2O_3$ | P | C | Si | S |
| 1 | Molten Mn-containing material | 25.0 | 0.4 | 26.0 | 28.0 | 6.0 | 8.0 | 0.008 | | | |
| 2 | Molten Mn-containing material | 38.7 | 0.5 | 18.0 | 18.5 | 5.0 | 8.0 | 0.009 | | | |
| 3 | Molten Mn-containing material | 16.7 | 0.3 | 32.2 | 29.5 | 8.1 | 8.0 | 0.006 | | | |

TABLE 1-continued

| No. | Raw material | Chemical composition (%) T.Mn | T.Fe | $SiO_2$ | CaO | MgO | $Al_2O_3$ | P | C | Si | S |
|---|---|---|---|---|---|---|---|---|---|---|---|
| 4 | Molten Mn-containing material | 12.8 | 0.3 | 35.5 | 28.8 | 8.5 | 10.4 | 0.005 | | | |
| 5 | Non-carbonaceous reducing agent | | | | | | | 0.020 | 0.07 | 77.5 | 0.01 |
| 6 | Non-carbonaceous reducing agent | 13.7 | | | | | | 0.035 | 0.10 | 65.9 | 0.01 |
| 7 | Non-carbonaceous reducing agent | | | | | | | 0.020 | 0.07 | 78.5 | 0.01 |
| 8 | Non-carbonaceous reducing agent | | | | | | | 0.020 | 0.07 | 77.0 | 0.01 |
| 9 | Non-carbonaceous reducing agent | | | | | | | 0.020 | 0.06 | 98.0 | 0.01 |
| 10 | Quick lime | | 0.2 | 0.5 | 90.0 | 2.2 | 0.2 | 0.007 | | | Ig.Loss 6.9 |
| 11 | Fluorite | | 0.1 | 4.0 | $CaF_2$ 82.0 | | 0.8 | 0.009 | | | |
| 12 | Mn ore | 49.5 | 2.5 | 4.5 | 1.0 | 2.5 | 3.5 | 0.031 | | | |

EXAMPLE 1

9,500 kg of molten material having the composition of raw material No. 1 in Table 1 was tapped from a furnace for producing Mn-containing ferroalloy and charged in a ten-ton reaction vessel. The temperature of the molten Mn-containing material at this time was 1,500° C. 800 kg of reducing agent No. 8, 500 kg of quick lime No. 10, 150 kg of fluorite No. 11 and 250 kg of manganese ore No. 12 were immediately added to the vessel (all at normal temperature). The reaction vessel was then subjected to horizontal eccentric circular motion at 45 cycles per minute for 18 minutes to rapidly mix and agitate the contents thereof. The slag that formed was thereafter skimmed off and the so produced ferromanganese was cast.

The amount of ferromanganese obtained was 2,500 kg and the composition thereof was as shown in Table 2. The yield of Mn was 91.2%.

TABLE 2

| Mn | C | (Wt. %) Si | P | S |
|---|---|---|---|---|
| 91.13 | 0.074 | 0.78 | 0.038 | 0.01 |

The amount of slag produced was 8,500 kg and the composition thereof was as shown in Table 3.

TABLE 3

| T. Mn | T. Fe | $SiO_2$ | (Wt. %) CaO | MgO | $Al_2O_3$ | P |
|---|---|---|---|---|---|---|
| 2.31 | 0.22 | 44.1 | 35.4 | 8.9 | 8.4 | 0.001 |

EXAMPLE 2

By the same method as described in Example 1, 8,100 kg of molten Mn-containing material No. 2 was charged in a ten-ton reaction vessel. The temperature of the molten Mn-containing material at this time was 1,480° C. 800 kg of reducing agent No. 9, 1,400 kg of quick lime No. 10 and 100 kg of fluorite No. 11 were thereafter added to the reaction vessel (both at normal temperature) and the vessel was subjected to horizontal eccentric circular motion at 45 cycles per minute for 23 minutes to rapidly mix and agitate the contents thereof. The slag was immediately skimmed off and the ferromanganese was cast.

The amount of ferromanganese obtained was 3,000 kg. The composition thereof was as shown in Table 4. The yield of Mn was 93.1%.

TABLE 4

| Mn | C | (Wt. %) Si | P | S |
|---|---|---|---|---|
| 97.33 | 0.077 | 0.86 | 0.028 | 0.01 |

The amount of slag produced was 7,000 kg and the composition thereof was as shown in Table 5.

TABLE 5

| T. Mn | T. Fe | $SiO_2$ | (Wt. %) CaO | MgO | $Al_2O_3$ | P |
|---|---|---|---|---|---|---|
| 2.41 | 0.10 | 43.5 | 35.0 | 9.5 | 9.1 | 0.002 |

EXAMPLE 3

By the same method as described in Example 1, 9,500 kg of molten Mn-containing material No. 3 was charged in a ten-ton reaction vessel. The temperature of the molten Mn-containing material at this time was 1,580° C. 500 kg of reducing agent No. 6 melted beforehand in a separate smelting furnace (1,430° C.), 70 kg of reducing agent No. 7 preheated to 700° C., 250 kg of quick lime No. 10, 100 kg of fluorite No. 11 and 200 kg of manganese ore No. 12 were thereafter added to the reaction vessel and the vessel was subjected to horizontal eccentric circular motion at 45 cycles per minute for 9 minutes to rapidly blend the contents thereof. The slag was skimmed off and the ferromanganese obtained was cast.

The amount of ferromanganese produced was 1,600 kg and the composition thereof was as shown in Table 6. The yield of Mn was 86.4%.

TABLE 6

| Mn | C | (Wt. %) Si | P | S |
|---|---|---|---|---|
| 90.98 | 0.072 | 0.86 | 0.047 | 0.01 |

The amount of slag produced was 8,800 kg and the composition thereof was as shown in Table 7.

TABLE 7

| | | | (Wt. %) | | | |
|---|---|---|---|---|---|---|
| T. Mn | T. Fe | $SiO_2$ | CaO | MgO | $Al_2O_3$ | P |
| 2.57 | 0.23 | 43.9 | 35.1 | 9.1 | 8.6 | 0.001 |

EXAMPLE 4

9,500 kg of molten Mn-containing material No. 4 (1,590° C.), 500 kg of reducing agent No. 5 preheated to 800° C., 400 kg of quick lime No. 10 and 100 kg of fluorite No. 11 were charged in a reaction vessel and the vessel was subjected to horizontal eccentric circular motion at 45 cycles per minute for 7 minutes during which reduction was carried out. Following complete skimming of the slag, 7,000 kg of molten Mn-containing material No. 4, 370 kg of reducing agent No. 5 preheated to 800° C., 300 kg of quick lime No. 10 and 75 kg of fluorite No. 11 were freshly added to the reaction vessel and the vessel was subjected to horizontal eccentric circular motion at 45 cycles per minute for 7 minutes. Following the completion of this reduction operation, the slag was again completely skimmed off and 5,000 kg of molten Mn-containing material No. 4, 260 kg of reducing agent No. 5 preheated to 800° C., 210 kg of quick lime No. 10 and 50 kg of fluorite No. 11 were freshly added to the reaction vessel and the vessel was subjected to horizontal eccentric circular motion at 45 cycles per minute for 4 minutes during which reduction was carried out. All of the slag which formed was removed.

The composition of the metal following this threestep operation was 80.11% Mn, 0.063% C, 9.82% Si, 0.042% P and 0.01% S. The slag composition was 2.28% T.Mn, 0.15% T.Fe, 42.8% $SiO_2$, 34.5% CaO, 8.9% MgO and 10.7% $Al_2O_3$ and the total amount of slag formed was 20,850 kg.

Next, to the reaction vessel containing this metal there was added 5,000 kg of molten Mn-containing material No. 4, 240 kg of quick lime No. 10 preheated to 800° C., and 60 kg of fluorite No. 11, whereafter the vessel was subjected to horizontal eccentric circular motion at 45 cycles per minute for 7 minutes to carry out desiliconization of the metal. Desiliconization was carried out twice under identical conditions.

The amount of slag formed in the first desiliconization was about 4,900 kg and the composition of this slag was 2.30% T.Mn, 0.06% T.Fe, 42.56% $SiO_2$, 34.82% CaO, 8.86% MgO and 10.72% $Al_2O_3$.

The amount of slag formed in the second desiliconization was about 5,000 kg and the composition of this slag was 5.04% T.Mn, 0.12% T.Fe, 40.13% $SiO_2$, 34.06% CaO, 8.67% MgO and 10.47% $Al_2O_3$.

The final metal obtained by this process weighed 3,350 kg and the composition thereof was 90.06% Mn, 0.051% C, 1.22% Si, 0.045% P and 0.01% S. The overall yield of Mn was 79.1%.

What is claimed is:

1. A method for the production of high-grade, high-purity ferromanganese consisting of not less than 90% Mn, not more than 1.5% Si, not more than 0.1% C and not more than 0.05% P comprising the steps of charging a molten Mn-containing material having a Mn content in the range from 10 to 40%, at least one non-carbonaceous reducing agent selected from the group consisting of Si-containing alloys, Al-containing alloys and Ca-containing alloys and a slagging material in a reaction vessel capable of performing horizontal eccentric circular motion and subjecting the reaction vessel to the said horizontal eccentric circular motion at between 35 and 65 cycles per minute to mix and agitate the contents of the vessel, whereby the Mn oxide contained in the molten Mn-containing material is reduced by the non-carbonaceous reducing agent.

2. A method according to claim 1, in which the horizontal eccentric circular motion to which the reaction vessel is subjected is carried out at between 40 and 50 cycles per minute.

* * * * *